United States Patent [19]

Dirham

[11] 4,055,856

[45] Nov. 1, 1977

[54] CHILD'S TOY HALO

[75] Inventor: Walter M. Dirham, Norman, Okla.

[73] Assignee: Osher M. Bachrach, Norman, Okla.

[21] Appl. No.: 627,831

[22] Filed: Nov. 3, 1975

[51] Int. Cl.[2] ..... A42C 1/00

[52] U.S. Cl. ..... 2/192; 2/171; D2/252

[58] Field of Search ..... 2/171, 182.6, 197, 180, 2/175, 195, 192, 199, 200; D2/230, 252; 46/1 L

[56] References Cited

U.S. PATENT DOCUMENTS

| | | | |
|---|---|---|---|
| 1,218,891 | 3/1917 | Pludowski | 2/182.6 X |
| 2,594,906 | 4/1952 | Gardner | 2/197 X |
| 2,705,751 | 4/1955 | Harris et al. | 2/185 R X |
| 2,787,791 | 4/1957 | Linney et al. | 2/197 |
| 3,156,925 | 11/1964 | Brunelle | 2/180 |
| D. 156,442 | 12/1949 | Levine | 2/199 X |
| D. 197,340 | 1/1964 | Collins | D2/252 |

*Primary Examiner*—Werner H. Schroeder
*Assistant Examiner*—Peter Nerbun
*Attorney, Agent, or Firm*—William R. Laney

[57] ABSTRACT

A toy halo comprising a flexible headband, a halo band and a supporting column interconnecting the headband and halo band. The headband, halo band and supporting column are an integrally formed, single piece unit. The invention also comprises a method of making the toy halo comprising bifurcating an elongated blank of flexible material by removing a strip from a central portion thereof to form two parallel legs joined at one end by a web; then folding the web upon itself along a line extending substantially normal to the longitudinal axis of the blank to form a triple thickness of the blank at the web; then securing the free ends of the legs to the web in its folded-upon-itself status to form the two bands.

1 Claim, 6 Drawing Figures

CHILD'S TOY HALO

BACKGROUND OF THE INVENTION

1. Field of the Invention

This invention relates to inexpensive party devices and children's toys, and to simple methods of making such devices and toys.

2. Brief Description of the Prior Art

A halo in the form of an annulus or circle placed above the head of the user is an often used part of Halloween costumes, party apparel, costumes used in dramatic productions and the like. Various ways have been heretofore provided for suspending the halo over the head of the user. One of the more prevalent of such methods is that of extending a wire up from a harness attached to the body of the user, with the wire extending along the back of the neck and to a position over the head to support the halo band or circle by attachment to one side thereof. This type of structure is, of course, cumbersome, as well as relatively expensive.

BRIEF DESCRIPTION OF THE PRESENT INVENTION

The present invention comprises a simple and inexpensive halo which can be used as a toy by children, as a prop in dramatic productions, as a portion of a Halloween costume and for a myriad of other uses. The halo of the invention can be quickly and easily made, and can be put together, in varying sizes, by the user, with only a stapler, brad or paperclip meeded for asembly.

Broadly described, the halo of the invention comprises a flexible headband, a halo band spaced from the headband and a supporting column interconnecting the headband and halo band. The headband, halo band and supporting column are an integrally formed single piece unit. In a preferred embodiment of the invention, the supporting column is a relatively stiff member comprising several thicknesses of the same material which is used to form the headband and halo band.

The invention also comprises a novel method of making the halo which comprises initially bifurcating an elongated blank of flexible material by removing a strip from a central portion of the blank, such as by die cutting, or, in a more simple practice of the method, by use of a pair of scissors. The blank, as thus cut away, yields two parallel, spaced-apart legs which are joined at one end by a web. The web at this time is sufficiently wide, as measured along a line extending parallel to the legs, that it can be folded upon itself one or more times to provide the thicknesses of material needed to achieve a relatively stiff supporting column. After folding the web back upon itself several times about lines which extend normal to the longitudinal axis of the elongated blank, the legs are then bent into circles or annuli, and the free ends of these legs are stapled or clipped to the folded-upon-itself web portion. Preferably, staples are used to secure the free ends of each leg to the web portion by passing the staple through the free ends of the legs and also the several folded thicknesses of the web portion. This completes the construction of the halo.

An important object of the present invention is to provide a very simple, inexpensive halo device which can be made and used by almost anyone, regardless of education or age, and which can be easily constructed to be worn by different persons having different head sizes.

Another object of the invention is to provide a simple, easily followed method for manufacturing a child's toy halo, either as a single unit, or in large quantities.

A further object of the invention is to provide a child's toy halo which can be manufactured and sold as a flat paper stock which can then be quickly and easily formed into the final halo by the end user, using a stapler, a brad or other similar, simple fastening device for completion of the halo.

Additional objects and advantages of the invention will become apparent as the following detailed description of certain preferred embodiments of the invention are read in conjunction with the accompanying drawing which illustrates such preferred embodiments.

BROAD DESCRIPTION OF THE DRAWINGS

DETAILED DESCRIPTION OF PREFERRED EMBODIMENTS OF THE INVENTION

Figure 1:
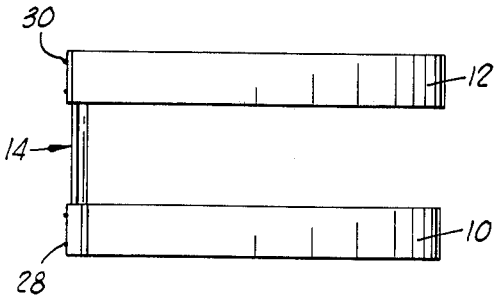
FIG. 1 is a side elevation view of a halo constructed in accordance with the present invention.

Referring initially to FIG. 1 of the drawings, the halo of the invention includes a headband 10, a halo band 12 and a supporting column which interconnects and spaces the halo band from the headband, such supporting column being designated generally by reference numeral 14. The headband 10 and halo band 12 are formed of a flexible, somewhat resilient material, such as cardboard, heavy paper or synthetic resin, and the column 14 comprises several thicknesses of the same material so that it is relatively stiff compared to the headband and halo band. The headband 10, halo band 12 and supporting column 14 are all formed from a single piece of material as one unitary member.

Figure 4:
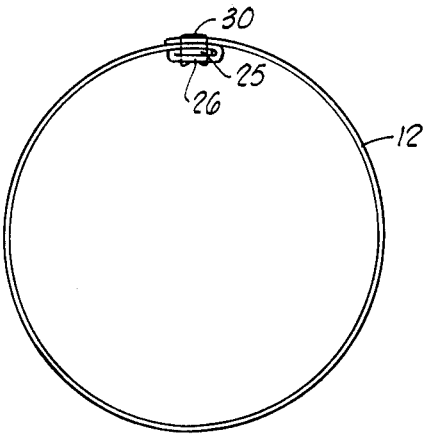
FIG. 4 is a top plan view of the halo shown in FIGS. 1–3.
Figure 3:
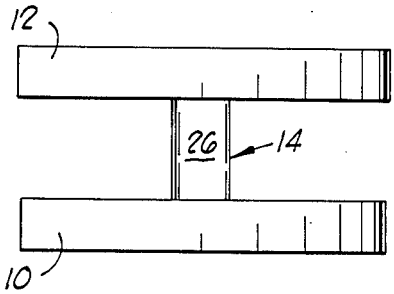
FIG. 3 is a side elevation view of the halo shown in FIGS. 1 and 2 depicting the halo as it appears from the opposite side thereof from that side shown in FIG. 2.
Figure 5:
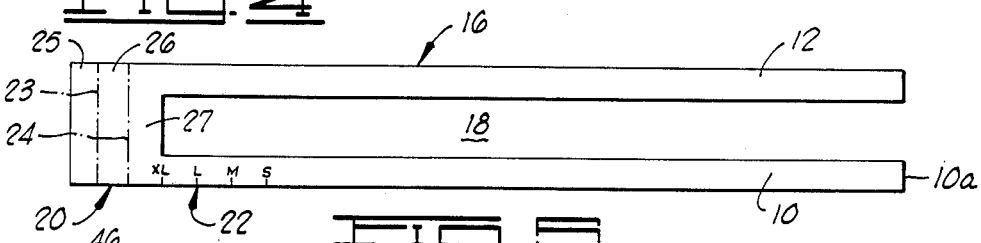
FIG. 5 is a plan view illustrating a blank upon which the method of the present invention has been partially performed preparatory to constructing the halo of the invention in the form in which it is illustrated in FIG. 1.

The precise construction of the halo, as well as the manner in which it is constructed will be better understood by referring to FIG. 5 in conjunction with FIGS. 1–4. In the method of constructing the halo of the invention, a blank, designated generally by reference numeral 16, is provided, and is an elongated, rectangular sheet of heavy paper, cardboard or plastic from which the halo will be constructed. By a cutting operation, such as die cutting or by the use of scissors, a generally rectangular strip is removed from along the longitudinal axis of the blank 16 to provide an elongated rectangular slot 18 extending inwardly from one end of the blank to a point spaced from the other end thereof.

The resulting structure, after this cutting step, is a flat, partially formed halo blank which is characterized in having a pair of parallel legs 10 and 12, each of substantially rectangular configuration, which legs are joined at one of their ends by a rectangular web portion designated generally by reference numeral 20. The legs 10 and 12 correspong to the headband and halo band, respectively, in the finished halo. After the blank has been cut to the shape depicted in FIG. 5, the blank is preferably printed with indicia which will designate the various possible head sizes of the end user of the finished halo. Thus, as designated generally by reference numeral 22, the blank 16 shown in FIG. 5 is marked with the letters "S", "M", "L" and "XL" to refer to small, medium, large and very large in correspondence to the various head sizes of possible end users of the halo. Also, in the manufacture of the blank shown in FIG. 5, a blank is preferably marked or scored with grooves along a pair of parallel lines 23 and 24 which extend transversely across the web portion 20 (or, stated differently, extend normal to the longitudinal axis of the blank 16), and which divide the web portion into three substantially equal-sized parallel, continuous segments, 25, 26 and 27.

Having formed and marked the blank in the manner illustrated in FIG. 5, the blank as thus cut, scored and marked can be sold in this form with the purchaser-end user performing the final assembly step. Alternatively, the complete halo can be formed by the manufacturer prior to sale to the end user. At whichever point the structure shown in FIG. 5 is formed to the completed halo shown in FIG. 1, the steps involved are identical.

Figure 2:
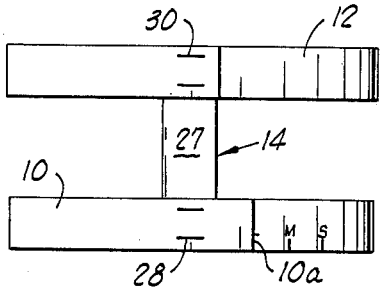
FIG. 2 is a side elevation view of the same halo shown in FIG. 1, except illustrating the halo as it appears when rotated 90° from the position in which it is illustrated in FIG. 1.

Thus, initially the web portion 20 will be folded about the two fold lines 23 and 24 so that the outer or end portion 25 is folded over the intermediate portion 26, and these in turn are folded over portion 27 in the manner best illustrated in FIG. 4. Next, the legs 10 and 12 are formed into circular configuration, and the free ends thereof are extended across the folded web portion 20. The leg 10 which becomes the headband of the halo is extended in overlapped relation to the portion of this same leg adjacent the web portion 20, until the end edge 10*a* of the leg is aligned with one of the size marker indicia 22 corresponding to the head size of the wearer (as shown in FIG. 2). At this time, one or more staples 28 are extended through the leg 10 which it crosses the folded web portion 20. The staple 28 is also extended through the superimposed folds of the web portion. In similar fashion, the leg 12 is curved into a band shape to form the halo, and the free end portion of this leg is extended across the web portion 20 after it has been so folded. One or more staples 30 is then pressed through the halo band 12 and through the several folded layers 25, 26 and 27 of the web portion 20 as best illustrated in FIG. 4. The halo is now complete and ready to be worn.

Figure 6:
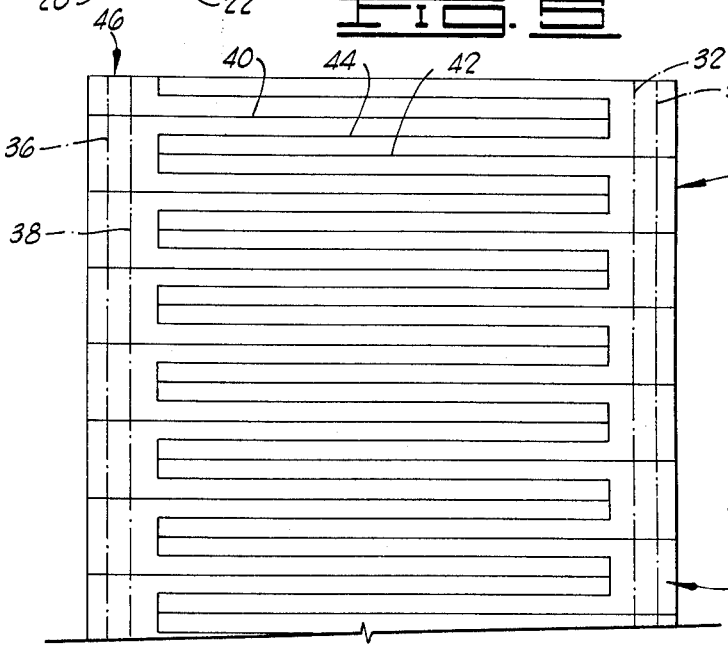
FIG. 6 is a plan view of a large blank from which a multiplicity of halos can be formed in accordance with the method of the present invention.

In FIG. 6 of the drawings, a large blank 31 is illustrated which can be die cut to form a plurality of the partially completed halos, in flat form as shown in FIG. 5. The blank 31 is provided with parallel fold lines 32 and 34 adjacent one side of the blank, and parallel fold lines 36 and 38 adjacent the other side of the blank. It should be pointed out that the fold lines as thus placed on the large blank can be either inked, or otherwise printed, indicia, or can be scored or perforated lines to increase the ease of folding along these lines at a later time during formation of the halo.

In a central portion of the blank 31, a plurality of solid lines representing lines along cuts are to be made are illustrated. It will be noted that alternate ones of these lines extend to the opposite side edges of the blank 31, these longer lines being denominated by alternating reference numerals 40 and 42. Between each pair of lines 40 and 42, a relatively short line 44 extends only between two opposed web portion, designated generally by reference numeral 46 and 48, forming the side edge portions of the blank.

The blank 31 as thus made up and marked for cutting and folding allows complete utilization of the large sheet of stock material used in forming a plurality of halos. Thus, by cutting along the solid lines 40, 42 and 44, at least 14 of the halos can be made from the blank shown in FIG. 6. Partially formed halos in the configuration shown in FIG. 5 are developed by such cutting, and these can be sold, as previously indicated, in flat form, or can be assembled in the finished fashion shown in FIG. 1, if desired, prior to sale.

From the foregoing description of the invention, it will be perceived that a simple, easily made and inexpensive child's halo toy is provided by the invention. The invention further contemplates a simple, inexpensive and easily practiced method of making the halos. Various changes can be made in the illustrated structures without departure from the basic principles of the invention. Also, some modification in the method steps carried out to manufacture the halo can also be employed without departure from the basic principles of the invention. Changes and innovations of this type are deemed to be circumscribed by the spirit and scope of the invention except as the same may be necessarily limited by the appended claims or reasonable equivalents thereof.

What is claimed is:

1. A method for making a halo device comprising:

bifurcating an elongated flat blank of flexible material of substantially rectangular shape by removing a strip from a central portion thereof to form a pair of elongated, spaced legs joined at one end by a web portion;

folding said web portion upon itself to form a multi-layered supporting column extending between said spaced legs; and bending the spaced legs into two spaced bands and securing the free ends of the legs to said multi-layered supporting column formed from said folded web portion.

* * * * *